US007839070B2

(12) United States Patent
Li et al.

(10) Patent No.: US 7,839,070 B2
(45) **Date of Patent: *Nov. 23, 2010**

(54) LATERAL FIELD EMISSION DEVICE

(75) Inventors: Jung-Yu Li, Hsinchu (TW); Shih-Pu Chen, Hsinchu (TW); Yi-Ping Lin, Hsinchu (TW); Wei-Chih Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 781 days.

This patent is subject to a terminal disclaimer.

(21) Appl. No.: 11/477,938

(22) Filed: Jun. 30, 2006

(65) Prior Publication Data

US 2010/0244661 A1 Sep. 30, 2010

(30) Foreign Application Priority Data

Dec. 29, 2005 (TW) ..... 94147099 A

(51) Int. Cl.
*H01J 63/04* (2006.01)

(52) U.S. Cl. ..... 313/495; 313/310; 313/494; 313/496; 445/24; 445/50; 445/51

(58) Field of Classification Search ..... 313/495–497, 313/309–311
See application file for complete search history.

(56) References Cited

U.S. PATENT DOCUMENTS

| | | | | |
|---|---|---|---|---|
| 5,402,041 | A * | 3/1995 | Kishino et al. | 315/169.1 |
| 6,250,984 | B1 * | 6/2001 | Jin et al. | 445/51 |
| 6,445,122 | B1 * | 9/2002 | Chuang et al. | 313/495 |
| 2002/0067114 | A1 * | 6/2002 | Choi et al. | 313/310 |
| 2004/0129930 | A1 * | 7/2004 | Ohnuma et al. | 257/10 |
| 2004/0245910 | A1 * | 12/2004 | Tang et al. | 313/483 |
| 2005/0062390 | A1 * | 3/2005 | Takeuchi et al. | 313/310 |

* cited by examiner

*Primary Examiner*—Sikha Roy
(74) *Attorney, Agent, or Firm*—Birch, Stewart, Kolasch & Birch, LLP

(57) ABSTRACT

A field emission device has pixels with cathode and anode provided on the same plane, so that electrons directly penetrate an independently provided fluorescent powder layer to produce light, giving the display the advantages of easy focusing, no dark spots, high brightness, and enhanced light emitting performance. Since the light produced by the fluorescent powder layer is not blocked by the anode, the problem of charge accumulation on the fluorescent powder layer is avoided, and it is not necessary to use expensive light-transmittable conducting glass as the anode. With the cathode and the anode located at the same plane, it is not necessary to use a high precision spacer to maintain a fixed distance between the cathode and the anode, enabling the device to be manufactured at reduced cost and high good yield.

24 Claims, 11 Drawing Sheets

LATERAL FIELD EMISSION DEVICE

FIELD OF THE INVENTION

The present invention relates to afield emission device, and more particularly to a field emission device in which field-emission electrons penetrate the fluorescent powder to produce light.

BACKGROUND OF THE INVENTION

A field emission display (FED) has the advantages of wide viewing angle, quick response speed, high luminescence efficiency, etc., and has long been considered as highly important in the development of flat TV. Unlike the liquid crystal display (LCD) that requires a backlight panel, the FED is a self-emission display and has an operational mechanism similar to that of a cathode-ray tube (CRT) display. The FED advantageously combines the slim and planar structure of the LCD display with the good picture quality of the CRT display. The field emission display (FED) is superior to the conventional LCD in many aspects, including the brightness, response speed, viewing angle, etc. Generally speaking, the FED is very suitable for use as a display. However, the conventional field emission display is hindered from being commercialized within a short time by several tough problems in the manufacturing process thereof.

FIG. 1 is a conceptual diagram of a conventional vertical type field emission device, which includes a cathode 20 having a field emitter 21, on which a carbon nano material is grown or an array of spindles is formed; an anode 10 that is an indium tin oxide (ITO) glass coated with a layer of fluorescent powder 11, and a gate 22 provided close to a top of the cathode 20. Due to a high electric field between the cathode 20 and the anode 10, field-emission electrons are emitted from the field emitter 21 of the cathode 20 in a vacuum space to impact the fluorescent powder 11 on the anode 10 for the fluorescent powder 11 to produce light. The gate 22 is connected to a relatively small positive electricity, so as to attract the cathode to increase the electron emissivity.

The above-described conventional vertical type field emission device is prevented from commercializing due to the following disadvantages: (1) It requires a spacer 12 to control a vertical distance between the cathode 20 and the anode 10; (2) since the allowable tolerance for the vertical type FED is very small, considerations in structural design and good yield must be taken when the vertical FED is applied to a large-area display; moreover, it is also very difficult to control the evenness of an overall brightness when the vertical FED is applied to a large-area display; (3) the electric current amount of the field-emission electron beam is very sensitive to the distance between the gate 22 and the cathode 20, and would have direct influences on the luminescent intensity of individual pixels; and since the distance between the gate 22 and the cathode 20 is very small that is measured in μm, it is very difficult to obtain uniform brightness for all pixels in the manufacturing process; moreover, the emitted electron beams tend to be out-of-focus and result in low contrast of pixels; (4) in the event the carbon nano material is not evenly grown on the field emitter 21 at the cathode 20, there would be some areas on the cathode 20 that do not have emitted electrons, resulting in dark spots on the fluorescent powder 11; (5) since the light from the fluorescent powder 11 would be blocked by the anode 10, the anode 10 must be an expensive light-transmittable conducting glass made of indium tin oxide; and (6) the gate 22 also requires additional manufacturing cost.

SUMMARY OF THE INVENTION

A primary object of the present invention is to provide a field emission device, of which pixels adopt a horizontal field emission light emitting structure for the field-emission electrons to directly penetrate the independently distributed fluorescent powder to produce light, so that the bottleneck and high cost in manufacturing the conventional field emission device are overcome.

To achieve the above and other objects, the field emission device according to the present invention includes a substrate, a plurality of pixels, a glass substrate, and a spacer. The pixels are arranged on the substrate in array, and each of the pixels includes a cathode, an anode, and a fluorescent powder layer, all of which are provided on a top of the substrate with the cathode and the anode located at two opposite sides of the fluorescent powder layer. With the electric field formed between the cathode and the anode, the electrons at the cathode are excited to directly penetrate the fluorescent powder layer for the same to produce light. The emitted electrons are then collected by the anode. The glass substrate is located above the pixels, and the spacer is clamped by and between the glass substrate and the substrate, so that a vacuum space is formed between the glass substrate and the substrate to enclose the pixels therein.

Since the fluorescent powder layer is not in contact with the cathode and the anode, and the electrons penetrated the fluorescent powder layer are not blocked by the anode, the problem of charge accumulation on the fluorescent powder layer can be avoided and the light produced by the fluorescent powder layer is not blocked by the anode, either. Therefore, it is not necessary to use an expensive ITO glass as the anode and a high precision spacer for maintaining a fixed distance between the cathode and the anode, and the manufacturing cost of the field emission device can be reduced.

In the present invention, it is possible to grow a carbon nano material, a conducting oxide, a metal structure, silicon, a nitride, or arrayed spindles on the cathode or the anode to serve as a cathodic field emitter or an anodic field emitter, allowing further increase of surface field at the cathode and reduction of operating voltage thereof. The light emitted from the pixels depends on the type of the fluorescent powder layer used. The fluorescent powder may be differently arrayed, and different driving circuits may be adopted, so that the field emission device of the present invention may be used in different applications.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
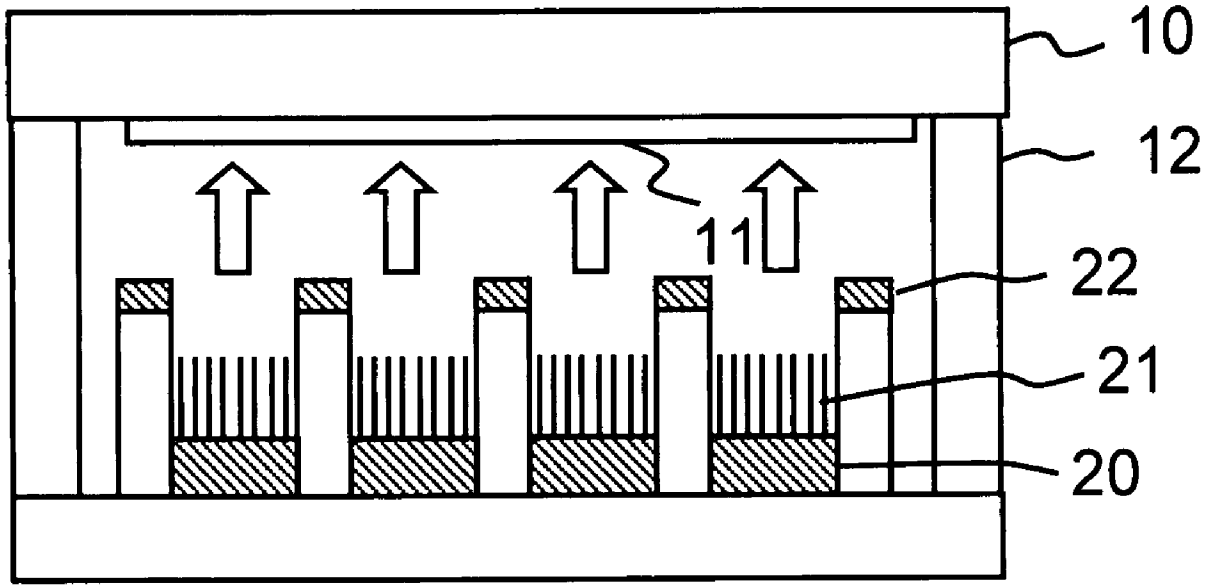
FIG.1(prior art)
FIG. 1 is a conceptual diagram of a convent ional vertical type field emission device.
Figure 2:
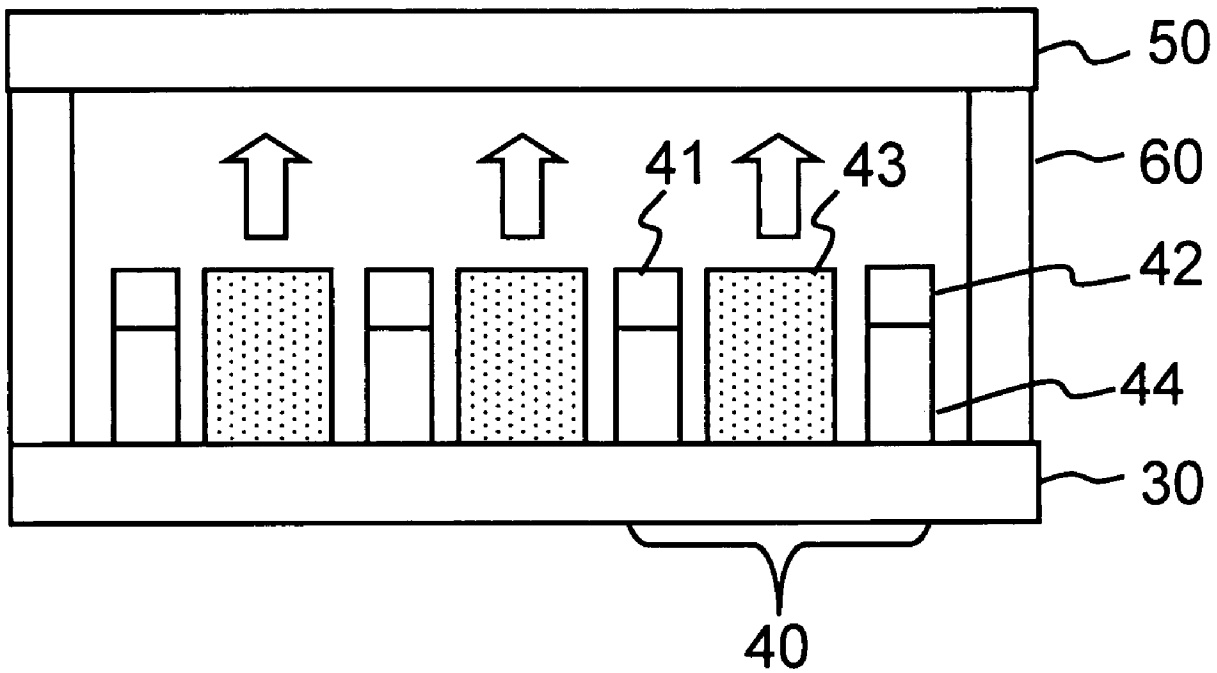
FIG. 2 is a conceptual diagram of a horizontal type field emission device according to a preferred embodiment of the present invention.

Please refer to FIG. 2 that is a conceptual diagram of a field emission device according to a preferred embodiment of the present invention. The field emission display of the present invention includes a substrate 30, a plurality of pixels 40, a glass substrate 50, and a spacer 60. In the illustrated preferred embodiment, the substrate 30 and the glass substrate 50 are spaced from each other using the spacer 60, and together define a vacuum space between them to enclose the pixels 40 therein. The pixels 40 are arranged in array, and each includes a cathode 41, an anode 42, and a fluorescent powder layer 43, all of which are provided on an upper surface of the substrate 30. The cathode 41 and the anode 42 are located at two opposite sides of the fluorescent powder layer 43. Since the fluorescent powder layer 43 is not in contact with the cathode 41 and the anode 42. When the electric field produced between the cathode 41 and the anode 42 induces electrons to release from the surface of the cathode. 41, the released electrons move in a direction substantially parallel to the surface of the substrate 30 to directly penetrate the fluorescent powder layer 43, so that the fluorescent powder layer 43 is excited to produce line-shaped light. The electrons are then attracted by the anode 42.

In the illustrated preferred embodiment, either the cathode 41 or the anode 42 is formed of a carbon nano material, so as to produce a high field and induce field-emission electrons to obtain low turn-on field and operating voltage. Alternatively, the cathode 41 or the anode 42 may be made of other materials capable of enhancing the field emission property, such as a conducting oxide, a metal structure, a nitride, silicon, or arrayed spindles, to achieve the same good effect. Wherein, the carbon nano material may be selected from the group consisting of carbon nanotubes, carbon nanowalls, and diamond-like films (i.e. diamond-like carbon). Zinc oxide (ZnO) is one of the oxides capable of enhancing the field emission property. Aluminum (Al), molybdenum (Mo), tungsten (W), or silicon (Si) may be selected as the metal structure to enhance the field emission property. And, gallium nitride (GaN), titanium nitride (TiN) or boron nitride (BN) may be selected as the nitride to enhance the field emission property.

Figure 3B:
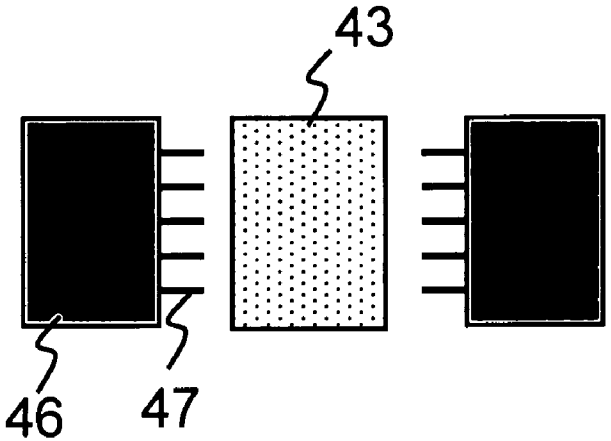
FIGS. 3A and 3B are side and top views, respectively, showing a carbon nano material is horizontally grown on side walls of the cathode and the anode of the field emission device of the present invention.
Figure 3A:
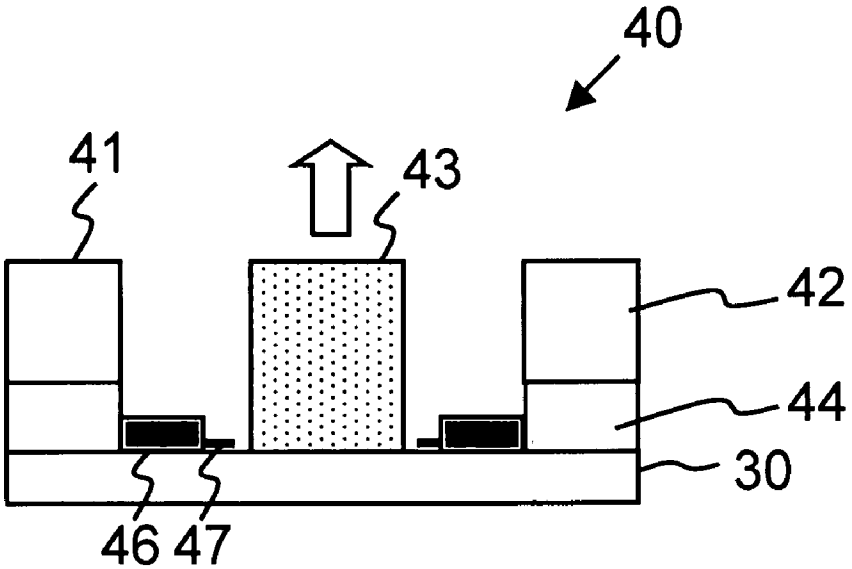

FIGS. 3A and 3B are side and top views, respectively, showing a carbon nano material 47 is horizontally grown on side walls of the anode 42 and the cathode 41. To grow the carbon nano material 47, first form a layer of metal film 46 on the substrate 30 for serving as a catalyst, and then grow multiple layers of carbon nano material 47 on the metal film 46. The catalyst may be iron, cobalt, nickel, or any combination thereof.

In the illustrated preferred embodiment of the present invention, the substrate 30 may be made of a highly insulating material, such as glass, ceramic, plastics, or Teflon. And, a conductive layer 44 is provided between the insulating substrate 30 and the cathode 41 and anode 42, so as to enhance the field intensity between the cathode 41 and the anode 42.

Figure 4:
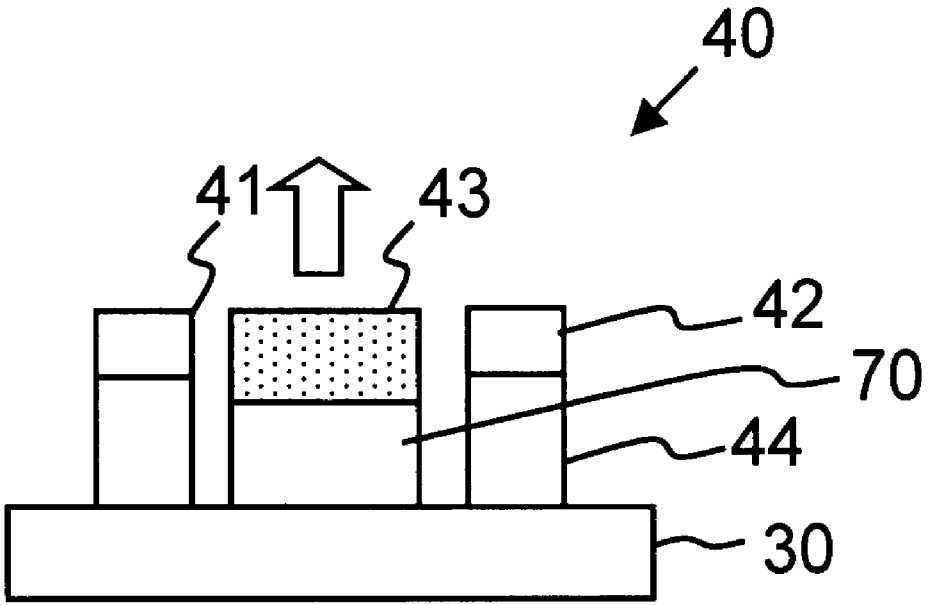
FIG. 4 is a conceptual diagram showing a pixel including a metal reflection layer according to another embodiment of the present invention.

In another embodiment of the present invention shown in FIG. 4, a metal reflection layer 70 is provided on the upper surface of the substrate 30 and below the fluorescent powder layer 43 to remove the phenomenon of light resonance and increase the brightness and luminescence efficiency. The metal reflection layer 70 must be isolated from the cathode 41 and the anode 42, and may serve as a grounding layer to eliminate charge accumulation on the fluorescent powder layer 43.

Figure 5:
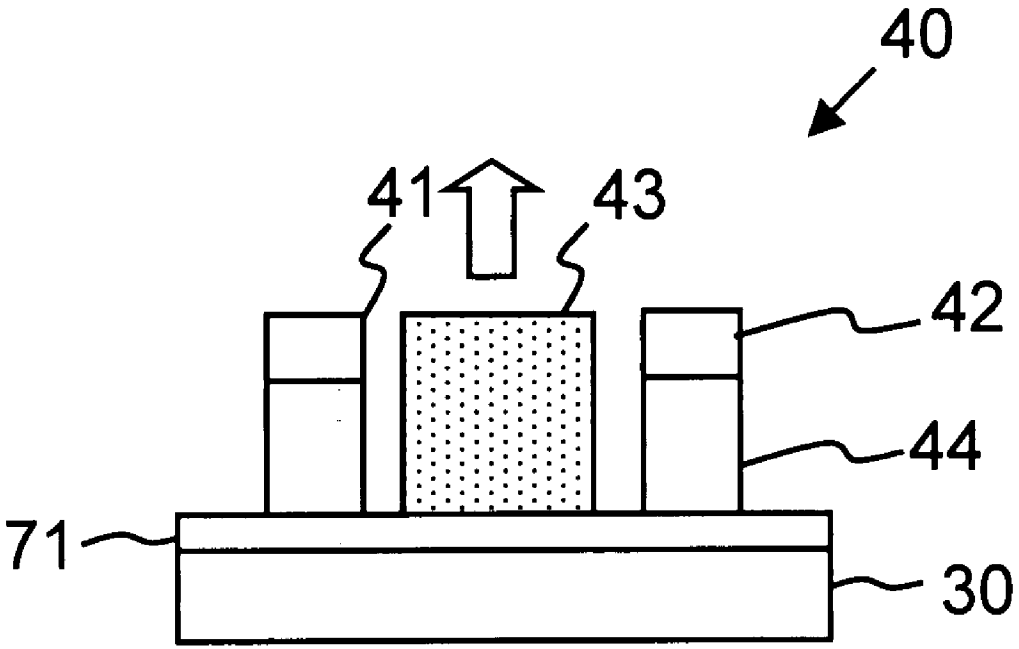
FIG. 5 is a conceptual diagram showing a pixel including a conductive layer according to a further embodiment of the present invention.
Figure 6:
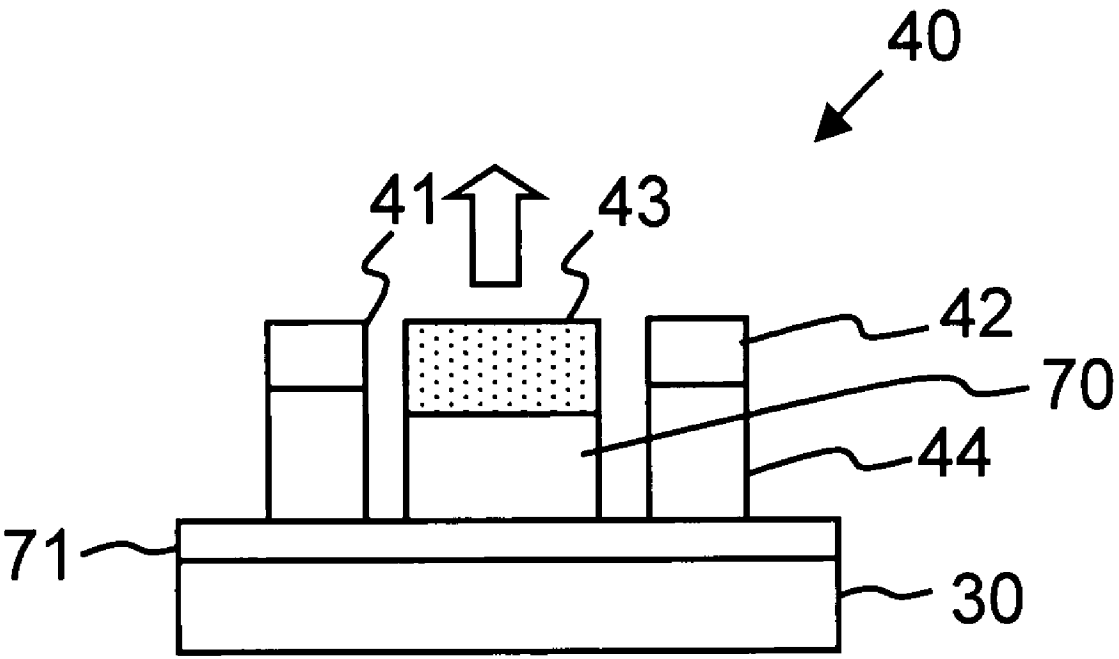
FIG. 6 is a conceptual diagram showing a pixel including a conductive layer and a metal reflection layer according to a still further embodiment of the present invention.
Figure 7:
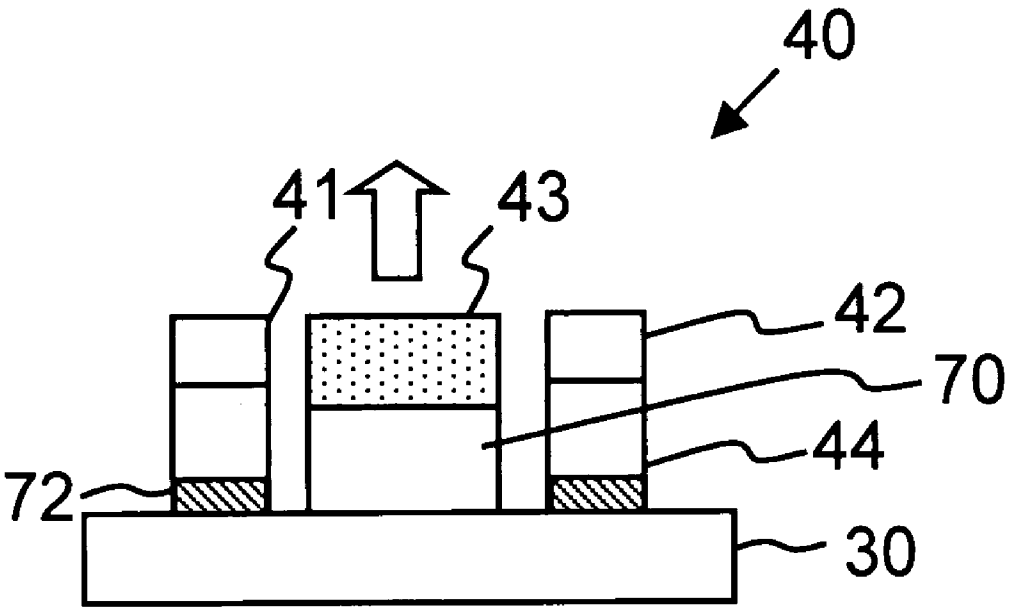
FIG. 7 is a conceptual diagram showing a pixel including a conductive layer according to a still further embodiment of the present invention, wherein the conductive layer is provided only between the substrate and the cathode and anode.

Alternatively, the substrate 30 may be a silicon substrate or a metal substrate plated with an insulating layer 71, so that the substrate 30 is insulated from the cathode 41 and the anode 42. In a further embodiment of the present invention shown in FIG. 5, a conductive layer 44 is provided below the cathode 41 and the anode 42, and an insulating layer 71 is located between the substrate 30 and the conductive layer 44 and the fluorescent powder layer 43. In a still further embodiment of the present invention shown in FIG. 6, in addition to the conductive layer 44, a metal reflection layer 70 is further provided below the fluorescent powder layer 43, and an insulating layer 71 is located between the substrate 30 and the conductive layer 44 and the fluorescent powder layer 43. In a still further embodiment of the present invention shown in FIG. 7, since the fluorescent powder layer 43 is not conductive, an insulating layer 72 is provided below the cathode 41 and the anode 42 only.

Figure 8:
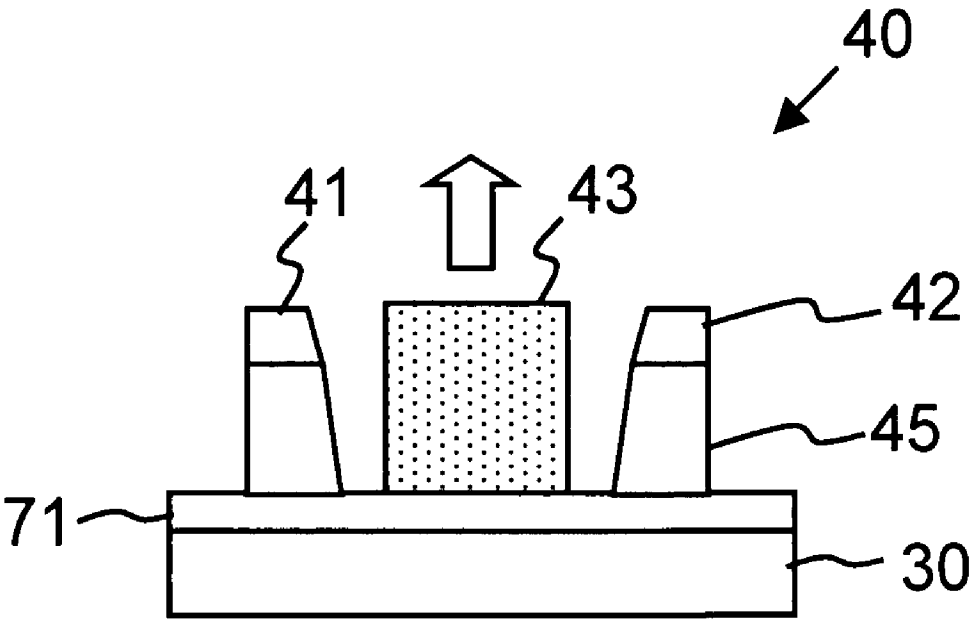
FIG. 8 is a conceptual diagram showing a pixel including a conductive layer according to a still further embodiment of the present invention, wherein the conductive layer is extended toward the fluorescent powder layer.

In a still further embodiment of the present invention shown in FIG. 8, a conductive layer 45 is provided below the cathode 41 and the anode 42 and extended toward the fluorescent powder layer 43, so that the electric field at the edges of the cathode 41 and the anode 42 is enhanced, and more field emission electrons could be emitted.

Light emitted from the pixel 40 has a wavelength dependent upon the type of the fluorescent powder layer used. The fluorescent powder layer may contain fluorescent powder of red (R), green (G), and blue (B) colors, and may be differently arrayed for different applications.

Figure 10:
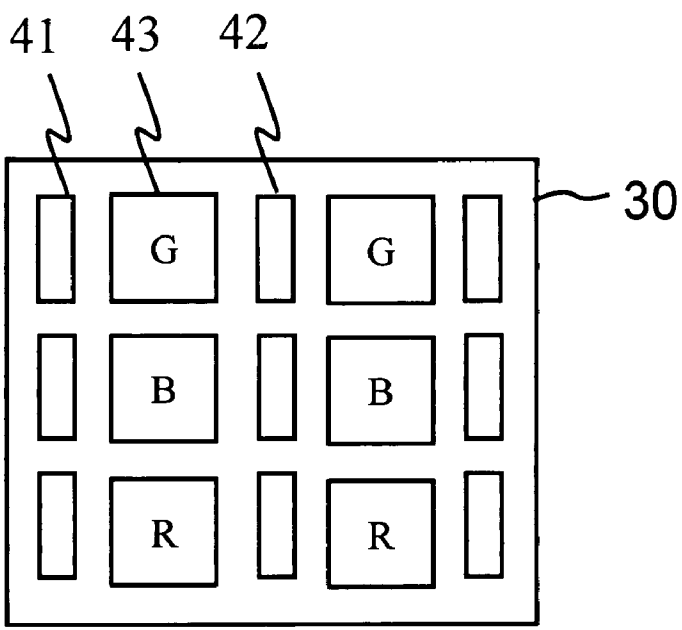
FIGS. 9 and 10 show two pixels of the field emission device of the present invention having the cathode, anode, and fluorescent powder layer differently arrayed thereon.
Figure 9:
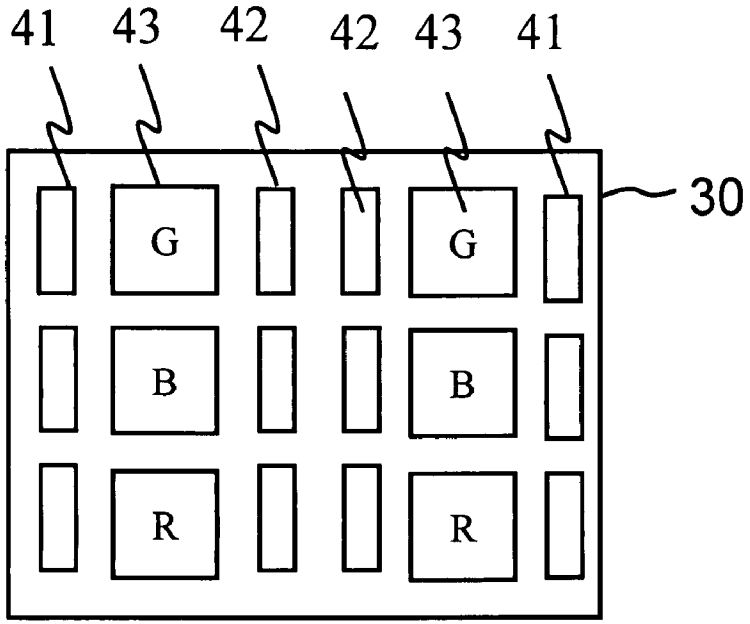

FIGS. 9 and 10 show that the cathode 41, the anode 42, and the red (R), green (G), and blue (B) fluorescent powder of the fluorescent powder layer 43 may be differently arrayed to separately produce R, G, or B pixels 40. The cathode 41 and anode 42 for the respective R, G, and B colors may be controlled by independent circuits. The produced R, G, B light may be mixed to produce different color systems. In the pixel structure shown in FIG. 9, each of the RGB fluorescent powder layers has independent cathodes and anodes. However, in the pixel structure shown in FIG. 10, RGB fluorescent powder layers in two adjacent rows have common cathodes 41 or anodes 42.

The pixel 40 may have a driving circuit structure similar to that used in the conventional dot matrix light-emitting device to save cost. For example, a passive matrix driving circuit or an active matrix driving circuit may be produced on the insulating substrate 30 or an insulating layer on the substrate 30 for controlling the display of picture. In practical operation, connect the cathode to a low voltage and the anode to a high voltage via the driving circuit beneath the substrate, and the field-emission electrons escaped from the cathode directly penetrate the independent fluorescent powder layer and be collected by the anode.

Figure 11:
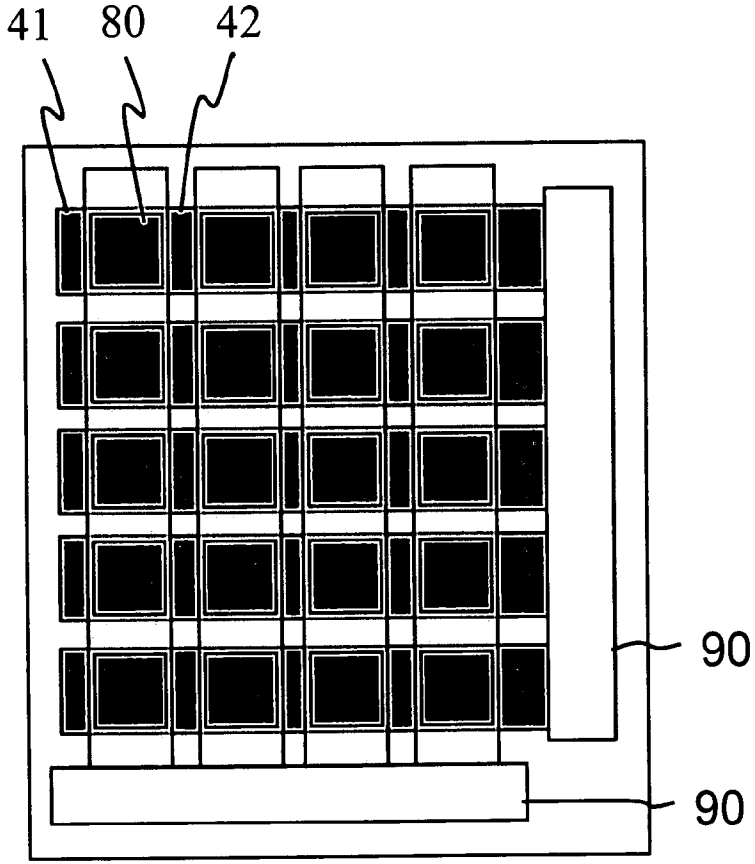
FIG. 11 is a conceptual diagram showing a pixel of the field emission display of the present invention adopting a passive matrix driving circuit.

FIG. 11 schematically shows a pixel having a passive matrix driving circuit 90. In the passive matrix driving circuit 90, the cathode 41 and the anode 42 are intersected with each other, allowing a luminescent space 80 at the intersection to emit light, so as to show characters or patterns. The passive matrix driving circuit 90 employs the same principle as the TV scanning lines, which utilizes time difference or time slicing for the first line to emit light of a relatively high brightness, and the second line to emit light at the next instant, and so on. Due to the after-image phenomenon, a viewer is able to see the characters or patterns.

Figure 12:
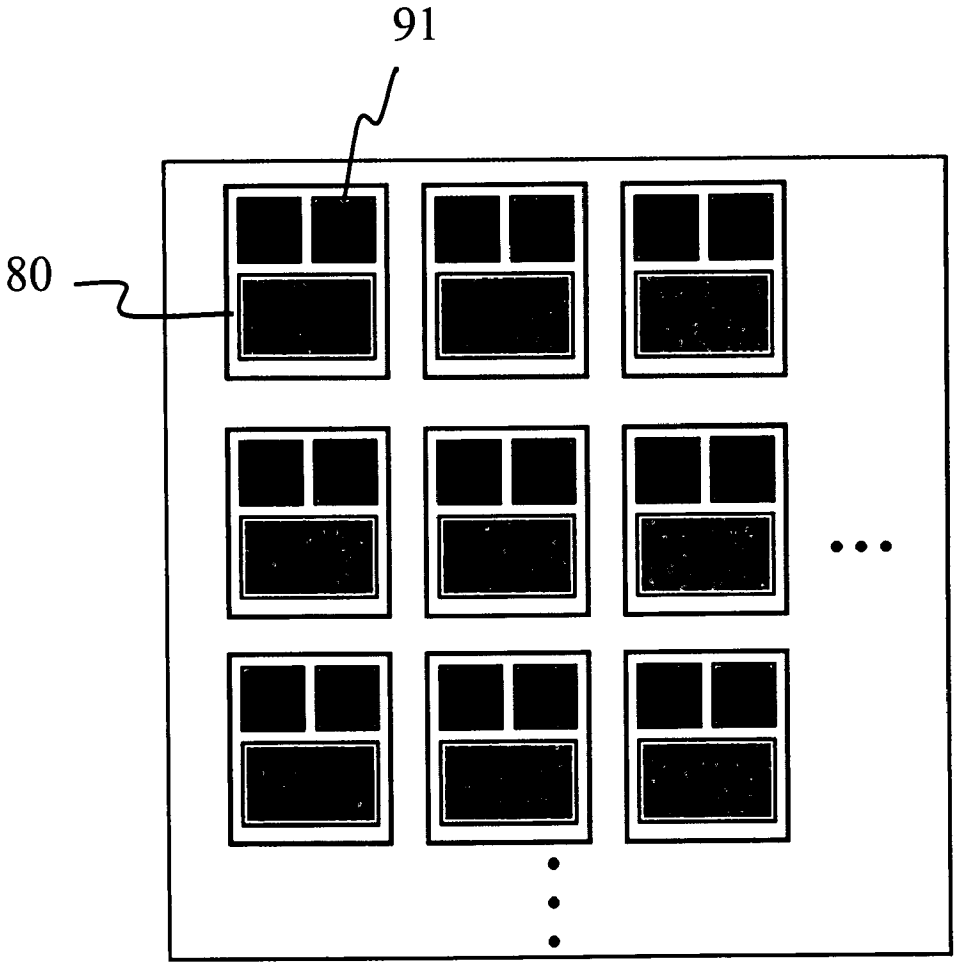
FIG. 12 is a conceptual diagram showing a pixel of the field emission display of the present invention adopting an active matrix driving circuit.

FIG. 12 schematically shows a pixel having an active matrix driving circuit. In the active matrix driving circuit, each individual luminescent space 80 is provided with a thin-film transistor (TFT) 91 as a switch. Unlike the passive matrix driving circuit 90 that sequentially causes every line to instantaneously emit light, the pixel with the active matrix driving circuit is continuously in an on state, and the luminescence intensity is controlled by the TFT 91.

Briefly speaking, the present invention provides a field emission device having a horizontal structure. Namely, the cathode, the anode, and the fluorescent powder layer of the pixel 40 are grown on the same plane to enable low turn-on voltage and operating voltage.

Since the fluorescent powder layer does not contact with the cathode and the anode, and light produced by the fluorescent powder layer is not blocked by the anode, the problems of charge accumulation on the fluorescent powder layer and high cost for an anode made of indium tin oxide glass could be eliminated.

In the present invention, since the electron penetrated through the fluorescent powder layer is not blocked by the anode, every electron is able to emit a linear light in its moving direction. On the contrary, in the conventional vertical type field emission device, each individual electron penetrated the fluorescent powder layer could move further by only a few micrometers to produce only one bright spot. Therefore, the horizontally structured field emission device of the present invention can produce a linear light source having an area much larger than the conventional spot light source, and may effectively emit more light beams to reduce the dark spots and largely increase the light emission uniformity. From existing experiments, the horizontally structured field emission device of the present invention may have luminescence efficiency as high as 30 Lm/W.

Moreover, with the vacuum sealing in the present invention, the conventional spacer located between the cathode and the anode may be omitted, and only a transparent substrate, such as a clear glass, is needed to achieve the same purpose of vacuum insulation and light transmission. Besides, it is known that the field emission performance is sensitive to the distance between the cathode and the anode, and a nano-scale precision for the distance must be maintained. However, in the present invention, the horizontal distance between the cathode and the anode can be precisely controlled by way of screen printing or optical lithography at largely reduced cost.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A lateral field emission device, comprising:

an insulating substrate;

a plurality of pixels arranged on an upper surface of said insulating substrate in array, and each of said pixels including:

a fluorescent powder layer provided on the upper surface of said insulating substrate;

a cathode provided on the upper surface of said insulating substrate adjacent to one side of said fluorescent powder layer; and an anode provided on the upper surface of said insulating substrate adjacent to another side of said fluorescent powder layer opposite to said cathode, wherein said fluorescent powder layer is provided between and spaced from said cathode and said anode so that electrons at said cathode are excited to directly penetrate said fluorescent powder layer and then move toward said anode in a direction substantially parallel to the surface of said insulating substrate; and a top substrate provided above said pixels; and a spacer clamped between said top substrate and said insulating substrate to together with said two substrates define a vacuum space for enclosing said pixels therein.

2. The lateral field emission device as claimed in claim 1, wherein said insulating substrate is made of an insulating material.

3. The lateral field emission device as claimed in claim 2, wherein said insulating material is selected from the group consisting of glass, ceramic, plastics, and Teflon.

4. The lateral field emission device as claimed in claim 1, further comprising an insulating layer formed on the upper surface of said insulating substrate below said cathode and said anode.

5. The lateral field emission device as claimed in claim 4, wherein said insulating substrate is selected from the group consisting of silicon substrate.

6. The lateral field emission device as claimed in claim 1, further comprising a conductive layer formed on the upper surface of said insulating substrate and below said cathode and said anode.

7. The lateral field emission device as claimed in claim 6, wherein said conductive layer is extended toward said fluorescent powder layer.

8. The lateral field emission device as claimed in claim 1, further comprising a metal reflection layer formed on the upper surface of said insulating substrate and below said fluorescent powder layer.

9. The lateral field emission device as claimed in claim 1, wherein each of said pixels has a common cathode.

10. The lateral field emission device as claimed in claim 1, wherein each of said pixels has a common anode.

11. The lateral field emission device as claimed in claim 1, wherein said fluorescent powder layer is selected from the group consisting of red (R), green (G), and blue (B) fluorescent powder.

12. The lateral field emission device as claimed in claim 1, wherein said cathode is selected from the group consisting of carbon nano material, conducting oxide, metal structure, silicon, nitride, and arrayed spindles.

13. The lateral field emission device as claimed in claim 12, wherein said carbon nano material is selected from the group consisting of carbon nanotube, carbon nanowall, and diamond-like carbon.

14. The lateral field emission device as claimed in claim 12, wherein said oxide is zinc oxide (ZnO).

15. The lateral field emission device as claimed in claim 12, wherein said metal structure is selected from the group consisting of aluminum (Al), molybdenum (Mo), tungsten (W), and silicon (Si).

16. The lateral field emission device as claimed in claim 12, wherein said nitride is selected from the group consisting of gallium nitride (GaN), titanium nitride (TiN) and boron nitride (BN).

17. The lateral field emission device as claimed in claim 1, wherein said anode is selected from the group consisting of carbon nano material, conducting oxide, metal structure, nitride, and arrayed spindles.

18. The lateral field emission device as claimed in claim 17, wherein said carbon nano material is selected from the group consisting of carbon nanotube, carbon nanowall, and diamond-like carbon.

19. The lateral field emission device as claimed in claim 17, wherein said oxide is zinc oxide (ZnO).

20. The lateral field emission device as claimed in claim 17, wherein said metal structure is selected from the group consisting of aluminum (Al), molybdenum (Mo), tungsten (W), and silicon (Si).

21. The lateral field emission device as claimed in claim 17, wherein said nitride is selected from the group consisting of gallium nitride (GaN), titanium nitride (TiN) and boron nitride (BN).

22. The lateral field emission device as claimed in claim 1, wherein each of said pixels further includes more than one thin-film transistor (TFT) for controlling a luminescence intensity of said pixel.

23. The lateral field emission device as claimed in claim 1, wherein said anode has a carbon nano material horizontally grown on a side wall of said anode.

24. The lateral field emission device as claimed in claim 1, wherein said cathode has a carbon nano material horizontally grown on a side wall of said cathode.

* * * * *